United States Patent [19]

Simkins

[11] Patent Number: 4,684,016

[45] Date of Patent: Aug. 4, 1987

[54] DISPLAY CASE FOR FRAGRANCE BOTTLES, JEWELRY, OR THE LIKE

[75] Inventor: Philip P. Simkins, New York, N.Y.

[73] Assignee: Steven W. Hewitt, Mt. Kisco, N.Y.; a part interest

[21] Appl. No.: 872,620

[22] Filed: Jun. 10, 1986

[51] Int. Cl.[4] ..... B65D 6/02

[52] U.S. Cl. ..... 206/45.13; 206/45.16; 206/45.2; 446/75

[58] Field of Search ..... 206/45.13, 45.14, 45.15, 206/45.16, 45.19, 45.2, 45.23; 446/75, 76

[56] References Cited

U.S. PATENT DOCUMENTS

| | | | |
|---|---|---|---|
| D. 99,545 | 5/1936 | Guttman | 206/45.19 X |
| D. 108,420 | 2/1938 | Braude | 206/45.15 X |
| 2,199,008 | 4/1940 | Oshei | 206/75 |
| 2,930,160 | 3/1960 | Pohl | 45/28 |
| 3,402,806 | 9/1968 | Sutherland et al. | 206/82 |
| 3,750,192 | 8/1973 | Beresic | 2/185 R |
| 3,784,046 | 1/1974 | Cata | 220/35 |
| 4,323,153 | 4/1982 | Courtin | 206/45.13 |
| 4,563,381 | 1/1986 | Woodland | 428/156 |

*Primary Examiner*—William Price
*Assistant Examiner*—Michael J. Shea
*Attorney, Agent, or Firm*—Wayne M. Kennard

[57] ABSTRACT

A display case (100) for displaying fragrance bottles, jewelry, or the like, having an enclosure member (101) defining a cavity (150), with the enclosure member (101) comprising four hingedly connected sections (102, 104, 106, 108), with two sections (102, 104) surmounting the other two sections (106, 108) and a tray member (152) rotatably connected to the hinge points (112, 200) connecting the two surmounting sections (102, 104), with the tray member (152) having a shape and size allowing for its disposition within the enclosure member cavity (150) when the display case (100) is closed and fully displayed when the display case (100) is open.

9 Claims, 6 Drawing Figures

DISPLAY CASE FOR FRAGRANCE BOTTLES, JEWELRY, OR THE LIKE

TECHNICAL FIELD

The field of the present invention relates to novel display cases used for displaying fragrance bottles, jewelry or the like. More specifically, the present invention relates to display cases which have an enclosure member defining a cavity, with the enclosure member comprising four hinged together sections, and a tray rotatably connected to the enclosure member and housed within the cavity when the display case is closed and displayed when the display case is opened.

BACKGROUND ART

There have been various types of display cases for fragrance bottles, jewelry, or the like, having a myriad of sizes and shapes (U.S. Pat. Nos. 2,199,008, 2,930,160, 3,402,806, 3,784,046; 3,784,046; and 4,323,153). However, prior art display cases do not provide a case which has an enclosure member defining a cavity, with the enclosure member comprising four hingedly connected sections, and a tray rotatably connected to the enclosure member and housed within the enclosure when the display case is closed and displayed for viewing when the display case is opened.

Therefore, the prior art does not disclose the novel features of the display case of the present invention.

SUMMARY OF THE INVENTION

The present invention is a display case for fragrance bottles, jewelry or the like.

The display case has an enclosure member which defines an interior spherical cavity when it is closed. The enclosure member comprises four sections that are hingedly connected. Each section defines a quarter of the spherical shaped cavity of the enclosure member.

The first and second sections of the enclosure member form the top of the display case and surmount the third and fourth sections which form the base of the display case. The exterior shapes of the first and second sections are quarter spheres. When the display case is closed and the first and second sections are adjacently disposed, they form a downwardly directed hemisphere. The third and fourth sections, surmounted by the first and second sections, have mirror image rectangular exterior shapes. When the display case is closed and the third and fourth sections are adjacently disposed, the third and fourth sections form a box-like base. So, the display case when closed preferably has an exterior configuration of a downwardly directed hemisphere mounted atop a box-like base. Further, when the display case is closed, the first and second sections, and the third and fourth section preferably defines half of the spherical cavity within the enclosure member.

The first and second sections are connected at two hinge points. Since the first and second sections have quarter spherical shapes, these sections have 90° of pivotal rotation with respect to each other about their connecting hinge points between the open and closed positions of the display case. The third and fourth sections are connected at two hinge points. Since the third and fourth sections have rectangular shapes, these sections also have 90° of pivotal rotation with respect to each other about their connecting hinge points between the open and closed positions of the display case.

The first section is also hinged to the fourth section it surmounts at a place remote from the hinge points connecting it to the second section. This hinge point is positioned 90° around the base of the first section from either hinge point connecting the first and second sections. In like manner, the second section is hinged to the third section it surmounts at a place remote from the hinge points connecting it to the first section. This hinge point is positioned 90° around the base of the second section from either hinge point connecting the first and second sections.

The tray has a hemispherical exterior shape and an upwardly opening cavity defined in it for receiving a fragrance bottle, jewelry, or the like. The tray is rotatably connected to the hinge points connecting the first and second sections..

The display case of the above described construction, has an exterior shape when closed of a hemisphere surmounting a box-like base, with the interior spherical cavity housing (or concealing) the upwardly directed hemispherical tray rotatably connected to the hinge points between the first and second sections. When the display case is closed, the hemispherical body of the tray is substantially disposed in the portion of the interior cavity defined by the third and fourth sections of the display case forming the base. Because of the hinged connections among the four sections of the display case, when the display case is opened, all four sections are rotated 90° from the positions they assume when the display case is closed. When so rotated, the base, formed by the third and fourth sections, still has a box-like exterior shape, but the portion of the interior cavity defined by these sections is now downwardly rather than upwardly directed. Once the first and second sections are rotated 90° with respect to each other, they form an upwardly directed cup-shaped, hemispherical cavity. By the tray being rotatably connected to the hinge points as described, when the display case is opened, the body of the tray is now disposed within the cup-shaped cavity formed by the first and second sections and the cavity in the tray remains upwardly directed.

An object of the invention is to provide a display case for fragrance bottles, jewelry, or the like, having four sections enclosure member defining an interior cavity the display case is close, and a tray rotatably connected to the enclosure member, with the tray being concealed in the cavity when the display case is closed and displayed when it is open.

Another object of the invention is to provide a display case for fragrance bottles, jewelry, or the like, having an enclosure member defining a spherical cavity, with the enclosure member comprising four hinged together sections each of which defining a quarter spherical of the cavity, a tray having a hemispherical exterior shape and an upwardly opening cavity defined therein, with the tray being rotatably connected to at least one of the hinge points connecting two of the sections, so that when the display is closed the tray member is housed within the cavity in the enclosure member and disposed in the portion of the cavity formed by the base sections of the enclosure member, and when the display case is opened, the tray is displayed in a second cavity formed by the top sections of enclosure member rotated 90° about their hinge points from their closed position.

These and other objects will be explained in greater detail subsequently.

BEST MODE FOR CARRYING OUT THE INVENTION

The present invention is a display case for fragrance bottles, jewelry and the like.

Figure 1:
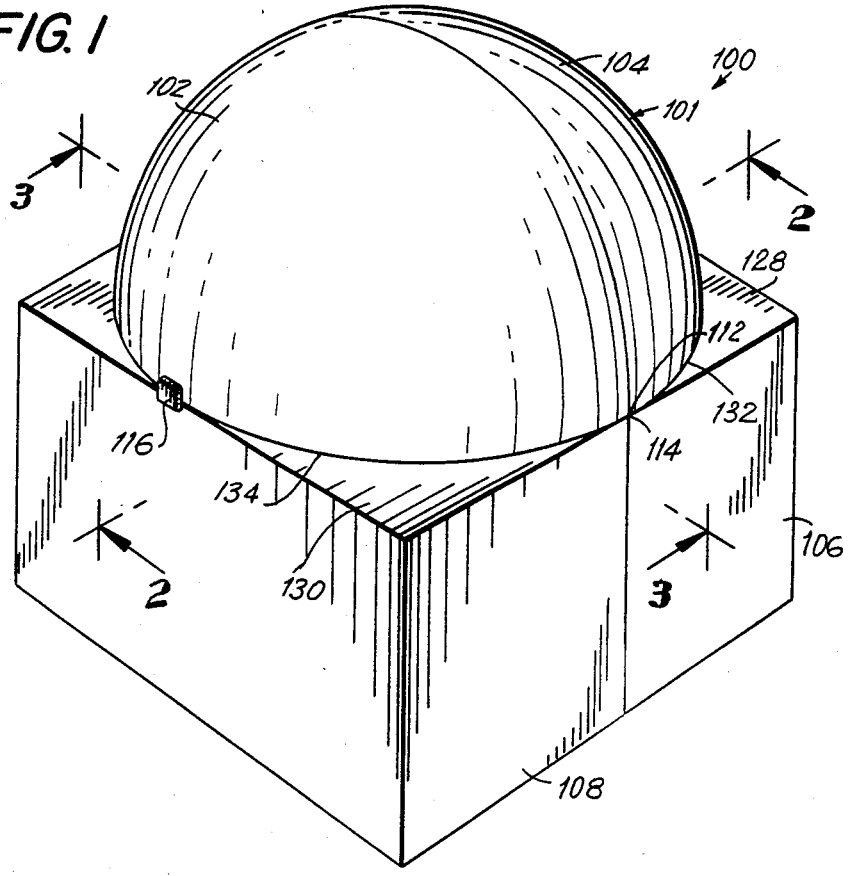
FIG. 1 shows a top perspective view of the preferred embodiment of the display case of the invention closed.
Figure 2:
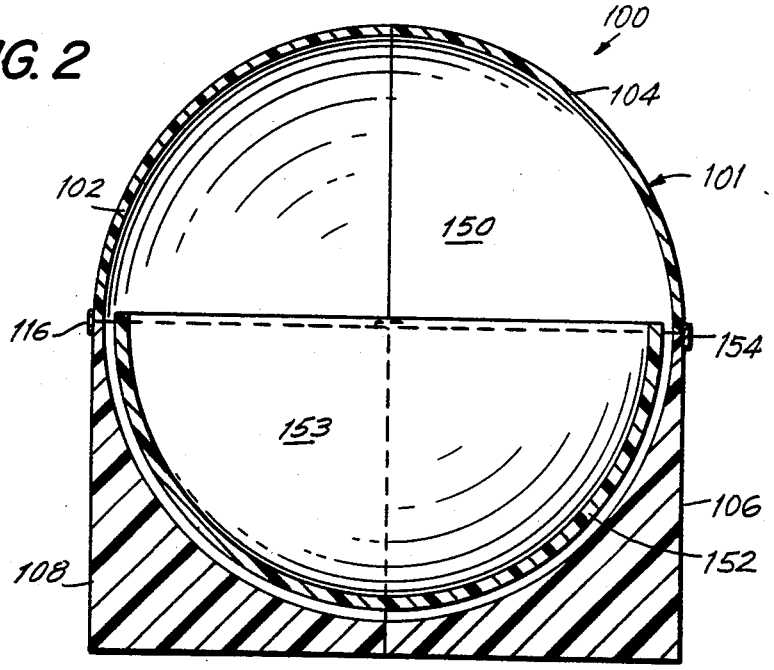
FIG. 2 shows a cross-sectional view of the display case of the invention along 2—2 of FIG. 1.
Figure 3:
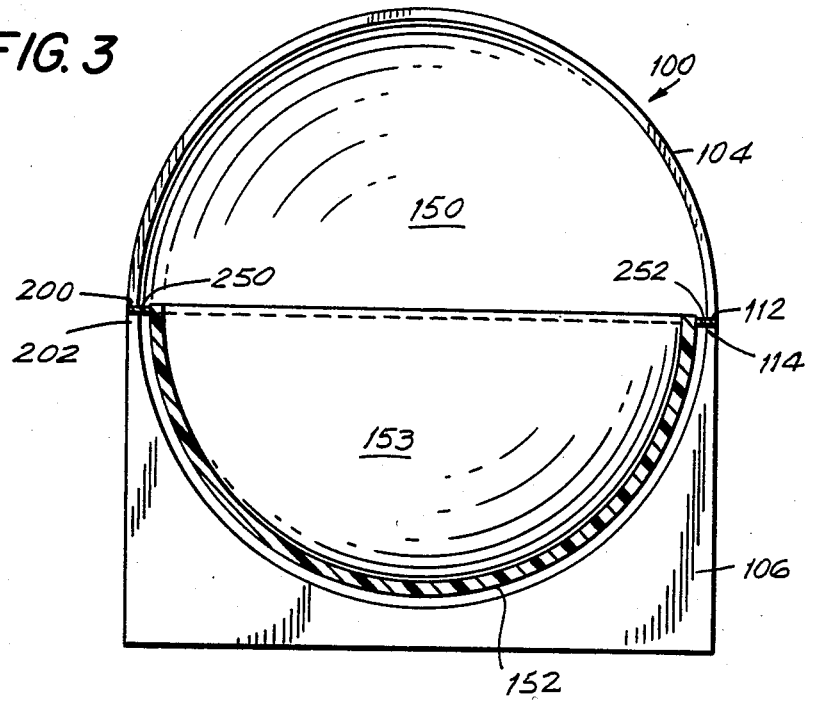
FIG. 3 shows a cross-sectional view of the display case of the invention along 3—3 of FIG. 1.

Referring to FIGS. 1, 2, 3 and 4, the elements of the display case of the invention will be described. Display case 100, as shown in FIG. 1, comprises enclosure member 101 which has interior spherical cavity 150. Enclosure member 101 comprises four hingedly connected sections, 102, 104, 106 and 108, and each defines a quarter of the spherical cavity when the display case is closed. Sections 102 and 104, which form the top of display case 100, each preferably has a quarter spherical exterior shape, are mirror images of each other and when the display is closed and they are disposed adjacent to each other form a downwardly disposed hemisphere. Sections 106 and 108, which form the base of display case 100, each preferably has a rectangular shape, are mirror images of each other and when the display case is closed and they are disposed adjacent to each other form a box-like base.

Top sections 102 and 104, which surmount base sections 106 and 108 of display case 100, are hinged at hinge points 112 and 200. Because of hinging at these points and other hinging to be described subsequently, and the quarter spherical shape of top sections 102 and 104, these sections rotate 90° with respect to each other between the closed and open positions of display case 100. The hinges used for this purpose are preferably thermoplastic strip hinges, with one hinge leg fixed to each section at each hinge point. The hinges at hinge points 112 and 200 are preferably formed from thermoplastic material because such hinges are lightweight, thin, durable and permit a large number of flexures without failure. However, it is understood that other types of hinges can be used as long as such other types of hinges permit the described rotation of sections 102 and 104 about hinge points 112 and 200 and a large number of flexures or hinge movements without failure.

Sections 106 and 108, which form the base of display case 100, are hinged at hinge points 114 and 202. Because of the hinging at these points and other hinging to be described subsequently, and the rectangular shape of base sections 106 and 108, these sections rotate 90° with respect to each other between the closed and open positions of display case 100. The hinges used for this purpose are also preferably thermoplastic strip hinges. These hinges have one hinge leg fixed to each section at each hinge point. These hinges, like those hinging sections 102 and 104, are preferably made from a thermoplastic material because such hinges are lightweight, thin, durable and permit a large number of flexures without failure. However, it is understood that other types of hinges can be used as long as they will permit the desired rotation of sections 106 and 108 with respect to each other and a large number of flexures or hinge movements without failure.

Top section 102 is also hinged to base section 108 by hinge 116, and the other top section, 104, is hinged to the other base section, 106, by hinge 154. Hinges 116 and 154 are positioned 90° around the base of section 102 and 104, respectively, from either hinge point 112 or 200 connecting top sections 102 and 104. Hinges 116 and 154 are also remote from hinge points 114 and 202 hingedly connecting third and fourth sections 106 and 108. Hinge 116 has portions fixed to top sections 102 and 108, and hinge 154 has portions fixed to base sections 104 and 106. Hinges 116 and 154 permit the sections connected by them to rotate 90° with respect to each other between the closed and open positions of display case 100. These hinges are preferably made from flat thermoplastic material. Hinges 116 and 154 are preferably constructed from thermoplastic material because it is lightweight, thin, durable and permits a large number of flexures without failure. However, it is understood that other types of hinges can be used as long as the desired hinging function can be carried out.

Tray 152 has a hemispherical exterior shape. Tray 152 has upwardly opening cavity 153 disposed in it. Tray 152 preferably has a hemispherical exterior shape so it can utilize the maximum usable area of the interior cavity for disposition of tray 152 and the fragrance bottle, jewelry, or the like, disposed within cavity 153 of tray 152. However, the size of the hemispherical exterior body of tray 152 below the rotation points connecting tray 152 to hinge points 112 and 200 is slightly less than the size of the hemispherical cavity formed by adjacent disposition of sections 102 and 104 when display case 100 is opened, and the hemispherical portions of the cavity formed by adjacent disposition of sections 106 and 108 when display case 100 is closed.

Tray 152 is rotatably connected to enclosure member 101 at hinge points 112 and 200 hingedly connecting sections 102 and 104 by rotation members 252 and 250, respectively. The rotational attachment of tray 152 to hinge points 112 and 200 by rotation members 252 and 250, respectively, enables tray 152 to freely rotate about its points of attachment so cavity 153 in tray 152 is normally upwardly directed in both the open and closed portion of display cases 100. Rotation members 252 and 250 can opposingly extend from the top edge of tray 152 and be pivotably seated in the hinges at hinge points 112 and 200, respectively, or rotation members 252 and 250 can opposingly extend inwardly from the hinges at hinge points 112 and 200, respectively, and be pivotably seated in the top edge of tray 152. Although only two methods of rotatably connecting tray 152 are described, other methods of rotatably connecting tray 152 to enclosure member 101 are considered within the scope of the invention.

Figure 5:
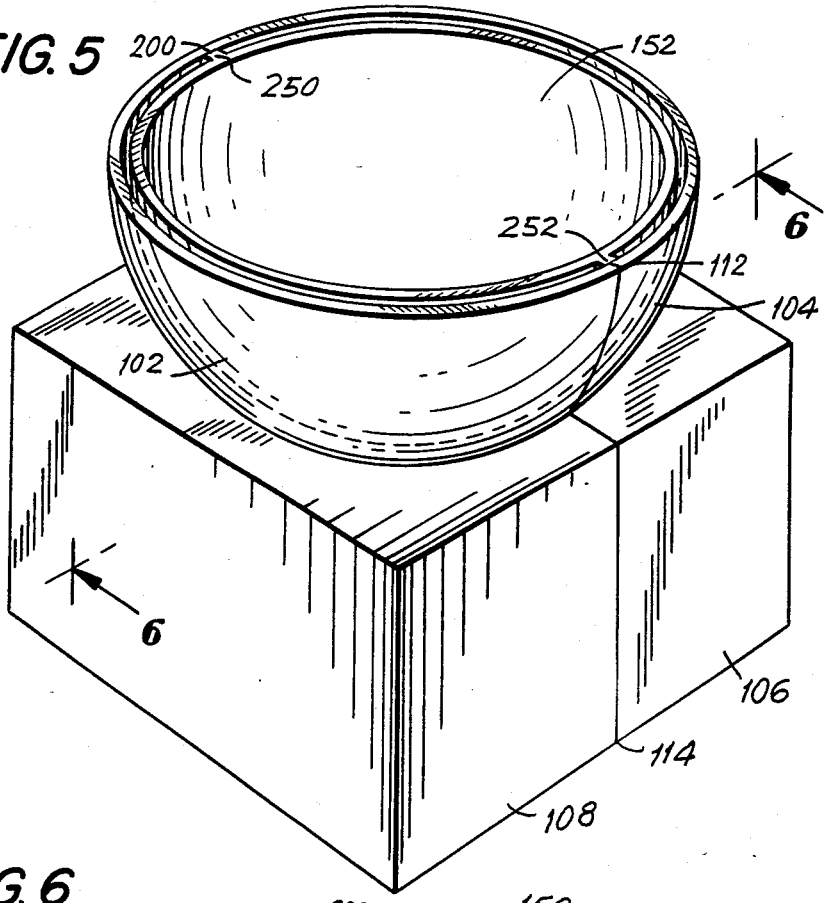
FIG. 5 shows the display case of FIG. 1 fully opened.
Figure 6:
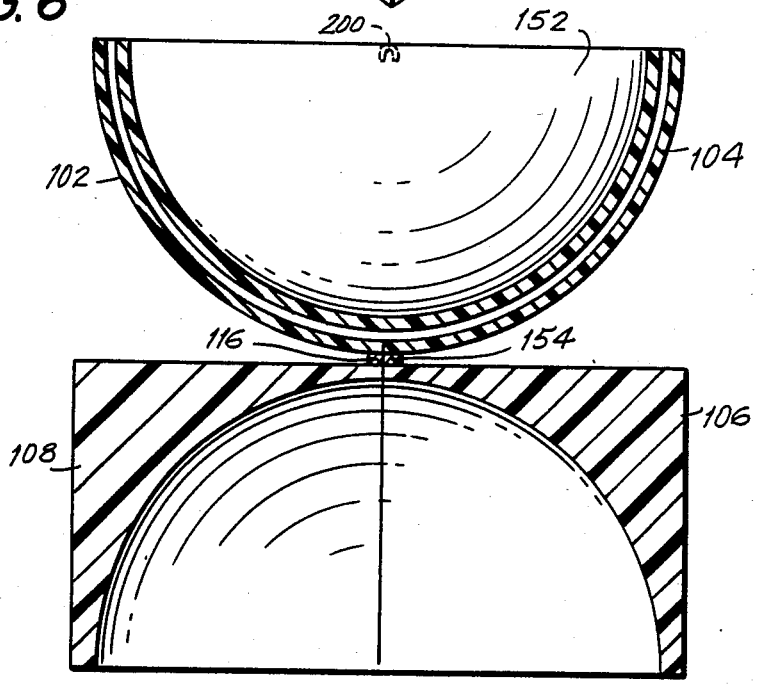
FIG. 6 shows a cross-sectional view of the display case of the invention along 6—6 of FIG. 4.

In the preferred embodiment of display case 100 shown in FIGS. 1, 2, 3 and 4, top sections 102 and 104 are described as having quarter spherical exterior shapes which when hinged together form the hemispherical top of display case 100. Sections 106 and 108, on the other hand, are described as having rectangular exterior shapes which when hinged together form the box-like base. When display case 100 is closed, hingedly connected sections 102, 104, 106 and 108 form the preferred configuration of display case 100 which is a hemispherical dome-top surmounting a box-like base. Also when display case 100 is closed, sections 102, 104, 106 and 108 define spherical cavity 150 of enclosure number 101, and hemispherical tray 152 with cavity 153 is disposed within the cavity and rotatably connected to hinge points 112 and 200 hingedly connecting sections 102 and 104. However, it is understood that the exterior shape of the display case 100 and the individual sections 102, 104, 106 and 108 which form enclosure member 101, can have different exterior shapes and still be within the scope of the invention. Further, cavity 150 within enclosure member 101, when display case 100 is closed, can have different shapes and still be within the scope of the invention. For example, cavity 150 can be cubical, elliptical or tubular. These are but a few of the many possible shapes of the interior cavity 150 which are still considered within the scope of the invention. Likewise, tray 152 can have different exterior shapes and still be within the scope of the invention. In this regard, the only limitation for tray 152 is that it fit within enclosure number 101 of display case 100 when display case 100 is closed and it fit in the cavity defined by top sections 102 and 104 when display case 100 is opened (FIGS. 5 and 6). This means that the exterior shape of tray 152 can be totally dissimilar from the shape of any portion of interior cavity 150. Therefore, when display case 100 is closed, the size of tray 152 above and below rotation members 250 and 252 is less than the size of the cavity formed by top sections 102 and 104 and base sections 106 and 108, and when opened, the size of tray 152 below rotation members 250 and 252 is less than the size of the cavity formed by top sections 102 and 104.

Referring to FIGS. 1, 4, 5 and 6, opening and closing of display case 100 will be described.

Figure 4:
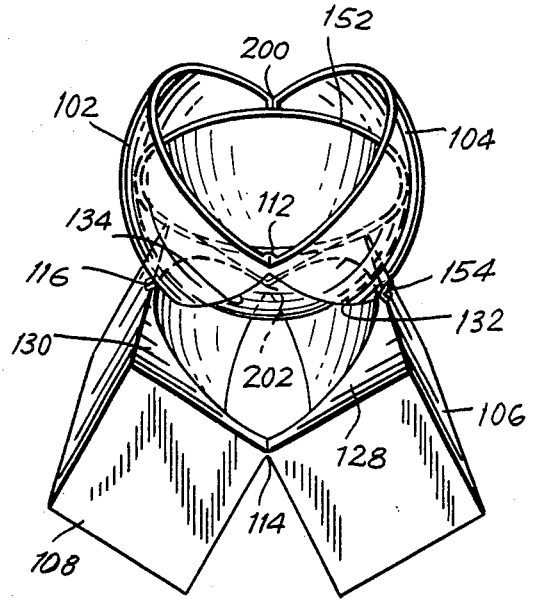
FIG. 4 shows the display case of FIG. 1 partially opened.

In opening display case 100 from its closed position, as shown in FIG. 1, to its partially opened position as shown in FIG. 4, base sections 106 and 108 are rotated inwardly about hinge points 114 and 202 so that their top surfaces, 128 and 130, respectively, pivot toward each other. Since base section 108 is hinged to top section 102 by hinge 116, 90° around base surface 134 of top section 102 from hinge points 112 and 200, and base section 106 is hinged to top section 104 by hinge 154, 90° around base surface 132 of top section 104 from hinge points 112 and 200, the inward rotation of base sections 106 and 108 cause top sections 102 and 104 to rotate about their hinge points, 112 and 200. The rotation of top sections 102 and 104 about hinge points 112 and 200, caused by the inward rotation of base sections 106 and 108, is such that bases 132 and 134 of sections 102 and 104, respectively, pivot toward one another, thereby, opening cavity 150 within enclosure member 101 revealing tray 152. Because of the rotational attachment of tray 152 to hinge points 112 and 200 connecting top sections 102 and 104, during opening of display case 100, cavity 153 in tray 152 remains upwardly directed, as shown in phantom in FIG. 4. Further inward rotation of base sections 106 and 108 about their hinge points 114 and 202, fully opens display case 100, as shown in FIG. 5.

When display case 100 is fully opened, top surfaces 128 and 130 of base sections 106 and 108, respectively, are adjacent each other, and base surfaces 134 and 132 of top sections 102 and 104, respectively, are adjacent each other. When display case 100 is opened, each of the sections, 102, 104, 106 and 108, have been rotated 90° from the position each assumed when display case 100 was closed. As such, the portion of the cavity defined by top sections 102 and 104 which was downwardly directed when display case 100 was closed, is now upwardly directed. In like manner, the portion of the cavity defined by base sections 106 and 108 which was upwardly directed, when display case 100 was closed, is now downwardly directed. Further, hinge points 112 and 200 hingedly connecting top sections 102 and 104 are remote from hinge points 114 and 202 hingedly connecting base sections 106 and 108, while flat hinge 116 hingedly connecting top section 102 and base section 108, and flat hinge 154 hingedly connecting top section 104 and base section 106 are adjacent to each other. Also, when display case 100 is open, tray 152, first section 102 and second section 104 are all substantially above, and base sections 106 and 108 are substantially below, flat hinges 116 and 154.

In the preferred embodiment, the cavity defined by top sections 102 and 104, which is upwardly directed when display case 100 is opened, has the same size and shape as the portion of cavity 150 these sections define when display case 100 is closed because top sections 102 and 104 each define a quarter of spherical cavity 150. However, it is within the scope of the invention that the shape of the cavity defined by top sections 102 and 104 when display case 100 is closed can be different from that defined by top sections 102 and 104 when display case 100 is opened. The same is true with respect to the portion of cavity 150 formed by base sections 106 and 108.

Once display case 100 is fully opened, as shown in FIG. 5, rotatably connected tray 152 is disposed in the upwardly directed, cup-shaped cavity formed by sections 102 and 104 rotated 90° from their positions when display case 100 is closed, enabling full display of tray 152 and its contents in tray cavity 153.

In closing display case 100, the reverse operation takes place. Top surfaces 128 and 130 of base sections 106 and 108, respectively, are rotated outwardly about hinge points 114 and 202 away from each other. The described rotation of base sections 106 and 108 also causes base surfaces 134 and 132 of top sections 102 and 104, respectively, to pivot away from each other because of the hinged connection between top section 102 and base section 108, top section 104 and base section 106, and top sections 102 and 104. Once the outward rotation of base sections 106 and 108 is complete, display case 100 is again closed concealing tray 152 and its contents in tray cavity 153 within cavity 150 of enclosure member 101 of display case 100. When display case 100 is closed, hinge points 112 and 200 hingedly connecting top sections 102 and 104 are adjacent to hinge points 114 and 202 hingedly connecting base sections 106 and 108, respectively, while flat hinge 116 hingedly connecting top section 102 and base section 108, and flat hinge 154 hingedly connecting top sections 104 and 106 are remote from each other. Also, tray 152 and base sections 106 and 108 are substantially below, and top sections 102 and 104 are substantially above, flat hinges 116 and 154.

Although the preferred embodiment of the invention is a display case, it is contemplated that the present invention can be embodied as a container or other type of housing or covering or packaging capable of being opened and closed for concealing and permitting access, respectively, to an article disposed in or on the tray.

The terms and expressions which are employed herein are used as terms of expression and not limitation. And, there is no intention, in the use of such terms and expressions, of excluding the equivalents of the features shown, and described, or portions thereof, it being recognized that various modifications are possible in the scope of the invention.

I claim:

1. A container capable of being moved from a closed position to an open position, comprising:

an enclosure member comprising a first section, a second section, a third section and a fourth section, the first, second, third and fourth sections being movable with respect to each other from an open position to a closed position and, in a closed position, defining a first cavity, with the first and second sections being hingedly connected at a first set of hinge points and the third and fourth sections being hingedly connected at a second set of hinge points, and with the first and fourth sections being hingedly connected at a position remote from the first and second sets of hinge points, and the second and third sections being hingedly connected at a position remote from the first and second sets of hinge points; and a tray member disposed in the first cavity when the first, second, third and fourth sections are in a closed position, the tray member being rotatably connected to the first set of hinge points and being arranged and constructed so that when the first, second, third and fourth sections are moved to an open position the tray member is exposed for access.

2. The container as recited in claim 1, wherein the first and fourth sections are connected to each other at a first single hinge point and the second and third sections are connected to each other at a second single hinge point.

3. The container as recited in claim 2, wherein when the container is in an open position:

(a) the first set of hinge points and second set of hinge points are remote from each other, and (b) the first single hinge point and the second single hinge point are adjacent to each other.

4. The container as recited in claim 2, wherein when the container is in a closed position:

(a) the first set of hinge points and second set of hinge points are adjacent to each other, and (b) the first single hinge point and the second single hinge point are remote from each other.

5. The container as recited in claim 2, wherein when the container is in a closed position the tray member is substantially below and the first section and second section are substantially above the first single hinge point and the second single hinge point and when the enclosure member is in an open position the tray member, the first section, and the second section are all substantially above the first single hinge point and second single hinge point.

6. The container as recited in claim 1, wherein the first cavity in the enclosure member is spherical.

7. The container as recited in claim 6, wherein first, second, third and fourth sections of the enclosure member each define a quarter of the spherical cavity in the enclosure member.

8. The container as recited in claim 6, wherein in both the open position and the closed position adjacent disposition of the first section and second section define a hemispherical portion of the first cavity.

9. The container as recited in claim 1, wherein the tray member has a second cavity defined therein for receiving an article.

* * * * *